US006265819B1

(12) United States Patent
Satou et al.

(10) Patent No.: US 6,265,819 B1
(45) Date of Patent: Jul. 24, 2001

(54) ELECTRON GUN STRUCTURE

(75) Inventors: Kazunori Satou; Junichi Kimiya, both of Fukaya; Shigeru Sugawara, Saitama-ken; Osamu Ono; Takashi Awano, both of Fukaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/180,826

(22) PCT Filed: Mar. 12, 1998

(86) PCT No.: PCT/JP98/01049

§ 371 Date: Nov. 13, 1998

§ 102(e) Date: Nov. 13, 1998

(87) PCT Pub. No.: WO98/40904

PCT Pub. Date: Sep. 17, 1998

(30) Foreign Application Priority Data

Mar. 13, 1997 (JP) ..... 9/059249

(51) Int. Cl.[7] ..... H01J 29/50

(52) U.S. Cl. ..... 313/417; 313/449; 313/447; 315/14

(58) Field of Search ..... 313/409, 411, 313/412, 413, 414, 416, 417, 441, 444, 446, 447, 448, 449, 451, 453, 456, 457, 458, 460; 315/14

(56) References Cited

U.S. PATENT DOCUMENTS 4,049,991 * 9/1977 Collins ..... 313/414 X
4,168,452 * 9/1979 Chistensen et al. ..... 313/449
4,484,102 * 11/1984 Hale ..... 313/417
4,935,663 * 6/1990 Shimoma et al. ..... 313/414
6,072,271 * 6/2000 Pontaillier et al. ..... 313/414

FOREIGN PATENT DOCUMENTS 57-128755 8/1982 (JP) .
58-818 1/1983 (JP) .
60-119061 6/1985 (JP) .
8-111186 4/1996 (JP) .
8-171869 7/1996 (JP) .

* cited by examiner

*Primary Examiner*—Vip Patel
*Assistant Examiner*—Mariceli Santiago
(74) *Attorney, Agent, or Firm*—Pillsbury Winthrop LLP

(57) ABSTRACT

An electron gun assembly includes a plurality of cathodes arranged in an in-line direction, at least first through fourth grids having electron beam passing holes arranged in an in-line direction, and an insulation support for sandwiching the cathodes and the grids between and fixing the cathodes and the grids from a direction perpendicular to the in-line direction. The second grid and the fourth grid are supplied with substantially the same low potential, the third grid is supplied with a potential higher than the potential of the fourth grid, and the second grid is fixed to the insulation support on a side of the third grid. The third grid has a cup-shaped electrode on a side of the second grid, the cup-shaped electrode including a plane portion having electron beam passing holes, an opening portion, and planting portions planted in the insulation support.

2 Claims, 8 Drawing Sheets

ELECTRON GUN STRUCTURE

This application is the national phase of international application PCT/JP98-/01049 filed Mar. 12, 1998 which designated the U.S.

TECHNICAL FIELD

The present invention relates to an electron gun assembly, and in particular to an electron gun assembly for color picture tube improved in withstand voltage characteristics.

BACKGROUND ART

An electron gun assembly for color picture tube has a function of generating an electron beam and focusing and accelerating the generated electron beam according to an object. In particular, a focusing lens system formed by a plurality of electrodes becomes an important element dominating the performance of the color picture tube.

The focusing lens system of the electron gun assembly for color picture tube functions to simultaneously focus three electron beams respectively corresponding to red (R), green (G), and blue (B). A bi-potential focus lens and a uni-potential focus lens are examples of a fundamental lens form of such a focusing lens system. As a matter of fact, a combination of these fundamental lens forms is utilized in order to improve the focusing performance. For example, various composite lens systems such as tri- potential focus type (abbreviated to TPF type), multi-step focus type (abbreviated to MSF type), and quadra-potential focus (abbreviated to QPF type) are utilized.

FIG. 1 is a diagram showing the schematic structure of a QPF type electron gun assembly described in Jpn. Pat. Appln. KOKAI Publication No. 54-72667.

The electron gun assembly includes a cathode 10, a first grid 11, a second grid 12, a third grid 13, a fourth grid 14, a fifth grid 15, and a sixth grid 16 disposed in the cited order along the same axis. Each grid has an electron beam passing hole which passes an electron beam emitted from the cathode 10.

The cathode 10 and the grids 11 through 16 are applied with respective predetermined potentials. The cathode 10, the first grid 11, and the second grid 12 emit thermions and form crossovers of electron beams. The second grid 12 and the third grid 13 form a pre-focus lens 17 to focus electron beams crossed over preliminarily. The third grid 13, the fourth grid 14 and the fifth grid 15 form an auxiliary lens 18. The fifth grid 15 and the sixth grid 16 form a main lens 19.

Recently, color picture tubes are required to be larger in size and higher in definition. The electron gun assembly is also required to have shorter inter-electrode distance values and higher precision. In particular, a triode ranging from the cathode 10 to the second grid 12 was formed so as to have relatively small inter-electrode distance values, but recently the inter-electrode distance values tend to become still smaller. As the inter-electrode distance becomes shorter, not only the assembling error of each inter-electrode distance but also inter-electrode distance changes caused by the influence of heat of a heater provided for the cathode 10 need to be made smaller.

As the second grid 12, a plate thicker than that of the first grid 11 is typically used. Thus, the heat capacity of the second grid 12 becomes large. After the heater of the cathode is ignited, it takes time until thermal stability is attained. Thus, the white balance immediately after the ignition of the heater tends to break down.

In order to solve this problem, there is disclosed in Jpn. UM Appln. KOKAI Publication No. 57-128755 an electron gun assembly including a second grid 12 having a thick flat plate 21 with a predetermined opening formed therethrough and a support 22 for fixing the thick flat plate 21 to bead glass 20 as shown in FIG. 2. The support 22 of the second grid 12 is curved toward a side opposite to the support side of the thick flat plate 21. In the structure of the second grid 12, the thick flat plate 21 is not directly fixed to the bead glass 20 and consequently the area of the thick flat plate 21 can be made small. As a result, its heat capacity can be made small and consequently it becomes possible to prevent the inter-electrode distance from being changed by thermal expansion.

However, the support 22 of the second grid 12 is disposed on the side of a third grid 13. For providing the distance between the second grid 12 and the third grid 13 with a predetermined value, therefore, it is necessary to make a portion of the third grid 13 located on the side of the second grid 12 smaller than an inside diameter 23 of an opening portion of the second grid 12 located in the support portion 22 and adopt such a structure that a face 24 of the third grid 13 opposed to the second grid 12 is surrounded by the support 22 of the second grid 12.

Conventionally, a portion of the third grid 13 located on the side of the second grid 12, i.e., an electrode of a third grid bottom is formed so as to have a cup-shaped structure as shown in FIGS. 3A through 3C or a cup-shaped structure as shown in FIGS. 4A through 4C.

FIG. 3A is a top view of an electrode seen from the side of a cathode 10. FIG. 3B is a sectional view of the electrode seen from an in-line direction, i.e., the horizontal direction. FIG. 3C is a side view of the electrode seen from a direction perpendicular to the in-line direction, i.e., the vertical direction. A bottom face 30 of the cup-shaped electrode shown in FIGS. 3A through 3C takes the shape of an approximately rectangle having longer sides in the horizontal direction. Furthermore, so as to make the shape of an opening portion 31 substantially the same as that of a bottom face 30, the longer sides of the bottom face 30 are joined to longer sides of the opening portion 31 with side walls 32 extended in the tube axis direction.

FIG. 4A is a top view of an electrode seen from the side of the cathode 10. FIG. 4B is a sectional view of the electrode seen from the horizontal direction. FIG. 4C is a side view of the electrode seen from the vertical direction. The electrode shown in FIGS. 4A through 4C has projections 33 respectively for individual electron beam passing holes.

FIG. 5 is a sectional view of a part of an electron gun assembly having the cup-shaped electrode shown in FIGS. 3A through 3C on the bottom of a third grid seen from the horizontal direction. In this shape, the distance between a folded portion 34 of a support 22 of the second grid 12 and a side wall 32 of the bottom of the third grid 13 is small and the withstand voltage characteristics is poor. In other words, the distance between the folded portion 34 and the side wall 32 is small, and in addition a large potential difference is formed between them. This results in a problem that a leak tends to occur.

Therefore, it is conceivable to use an electrode having a narrowed width of the bottom face in the vertical direction as shown in FIG. 6A through 6C. FIG. 6A is a top view of the electrode seen from the side of the cathode 10. FIG. 6B is a sectional view of the electrode seen from the horizontal direction. FIG. 6C is a side view of the electrode seen from the vertical direction. If the electrode shown in FIGS. 6A through 6C is used, the distance between the folded portion 34 of the second grid 12 and the side wall 32 of the third grid 13 can be widened, and consequently the problem of the leak is eliminated. Since the inside diameter of a side of the opening 39 of the third grid bottom becomes small, however, an electric field 36 of the auxiliary lens penetrating from the side of the fourth grid 14 to the side of the third grid 13 is affected. Thus there occurs a problem that a lens which is asymmetric in the horizontal direction and the vertical direction is formed. As a result, a beam spot formed on a screen does not take the shape of a circle but takes a distorted shape.

If the electrode taking the shape shown in FIGS. 3A through 3C or FIGS. 6A through 6C is used, either the withstand voltage characteristics or the auxiliary lens characteristics are sacrificed.

Furthermore, if the third grid bottom takes the shape shown in FIGS. 4A through 4C, then the distance between a support 22 of the second grid 12 and a third grid side wall portion 37 is widened, and consequently the withstand voltage characteristics are improved. Furthermore, since an opening side 38 of the third grid bottom can also be widened, the influence exerted upon the auxiliary lens can be decreased. Since the projections 33 are disposed respectively for the individual electron beam passing holes, the shape becomes complicated. Furthermore, individual position precision between the projections 33 and the electron beam passing holes becomes necessary not only in the vertical direction but also in the horizontal direction. As a result, the manufacturing becomes difficult, and there is a fear of an increase in cost.

In the conventional electron gun assembly, and in particular in the electron gun assembly of QPF type, the thick flat plate of the second grid is fixed to the bead glass by using the support which takes such a shape that the support is folded to the third grid side as described above. The method poses a problem that the withstand voltage characteristics are degraded or the electric filed characteristics of the auxiliary lens formed between the second grid and the third grid are affected, depending upon the shape of the part of the third grid located on the second grid side. Furthermore, if it is attempted to solve these problems, the shape of the electrode becomes complicated and there is a fear of an increased cost.

DISCLOSURE OF INVENTION

The present invention has been made to solve the above described problems. An object of the present invention is to provide an electron gun assembly having an electrode which has such a simple structure that the withstand voltage characteristics can be improved without affecting the auxiliary lens.

In accordance with the present invention, there is provided an electron gun assembly including a plurality of cathodes arranged in an in-line direction, a plurality of grids containing at least first through fourth grids having electron beam passing holes arranged in an in-line direction, and an insulation support for sandwiching the cathodes and the grids between and fixing the cathodes and the grids from a direction perpendicular to the in-line direction, the second grid and the fourth grid being supplied with substantially same low potentials, the third grid being supplied with an potential higher than the potential of the fourth grid, and the second grid being fixed to the insulation support on a side of the third grid with respect to a plane having the electron beam passing holes, wherein the third grid includes a cup-shaped electrode on a side of the second grid, the cup-shaped electrode includes a plane portion having electron beam passing holes and planting portions planted in the insulation support, each of the plane portion and an opening portion formed between the planting portions takes a shape of substantially a rectangle having longer sides in the in-line direction, and a width.of the opening portion in the direction perpendicular to the in-line direction is larger than a width of the plane portion in the direction perpendicular to the in-line direction.

BEST MODE OF CARRYING OUT THE INVENTION

Figure 1:
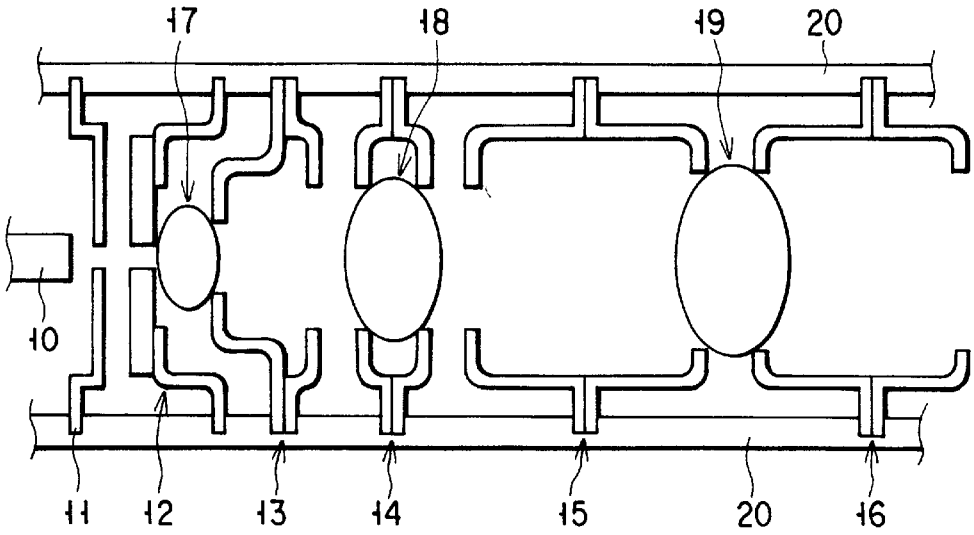
FIG. 1 (PRIOR ART)
FIG. 1 is a sectional view schematically showing a conventional electron gun assembly of QPF type applied to color picture tubes.
Figure 2:
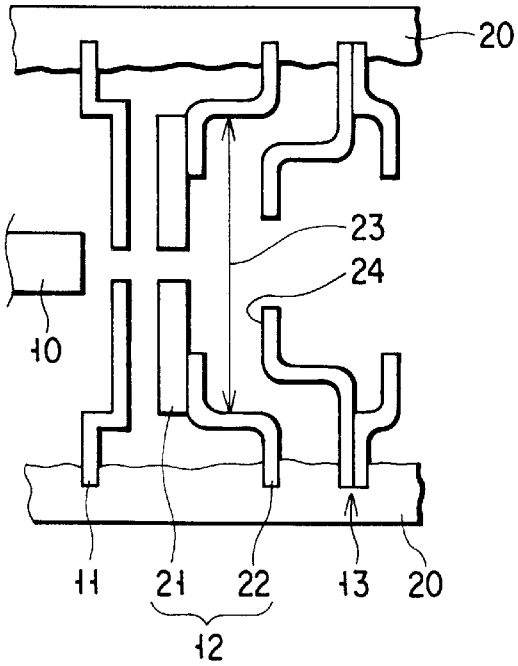
FIG. 2 (PRIOR ART)
FIG. 2 is a sectional view showing the structure of the electron gun assembly of QPF type shown in FIG. 1 ranging from a cathode to a third grid.
Figure 3A:
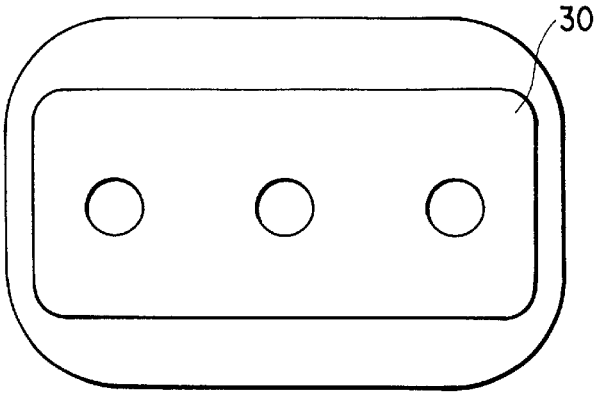
FIG. 3A (PRIOR ART)
FIG. 3A is a top view of a cup-shaped electrode applied to a third grid of the conventional electron gun assembly seen from a second grid side.
Figure 3B:
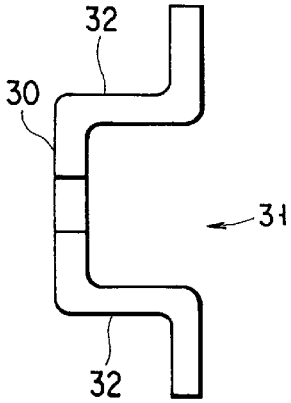
FIG. 3B (PRIOR ART)
FIG. 3B is a sectional view of a cup-shaped electrode applied to a third grid of the conventional electron gun assembly seen from an in-line direction.
Figure 3C:
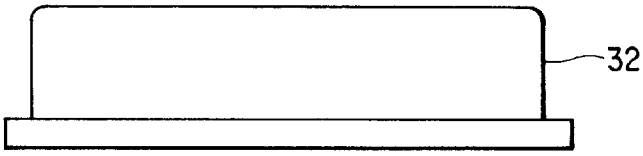
FIG. 3C (PRIOR ART)
FIG. 3C is a sectional view of a cup-shaped electrode applied to a third grid of the conventional electron gun assembly seen from a vertical direction.
Figure 4A:
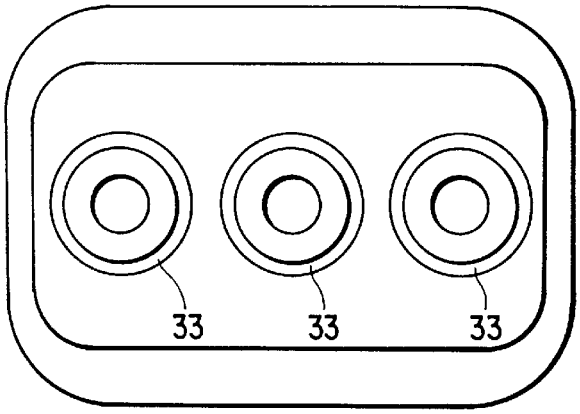
FIG. 4A (PRIOR ART)
FIG. 4A is a top view of a cup-shaped electrode applied to a third grid of the conventional electron gun assembly seen from a second grid side.
Figure 4B:
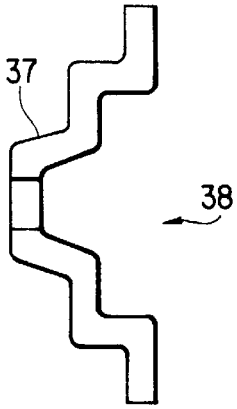
FIG. 4B (PRIOR ART)
FIG. 4B is a sectional view of a cup-shaped electrode applied to a third grid of the conventional electron gun assembly seen from an in-line direction.
Figure 4C:
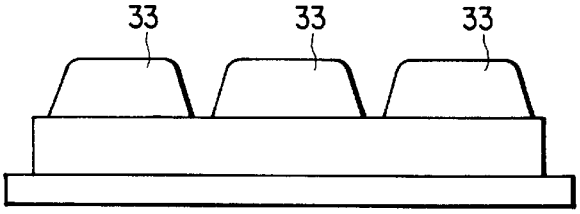
FIG. 4C (PRIOR ART)
FIG. 4C is a sectional view of a cup-shaped electrode applied to a third grid of the conventional electron gun assembly seen from a vertical direction.
Figure 5:
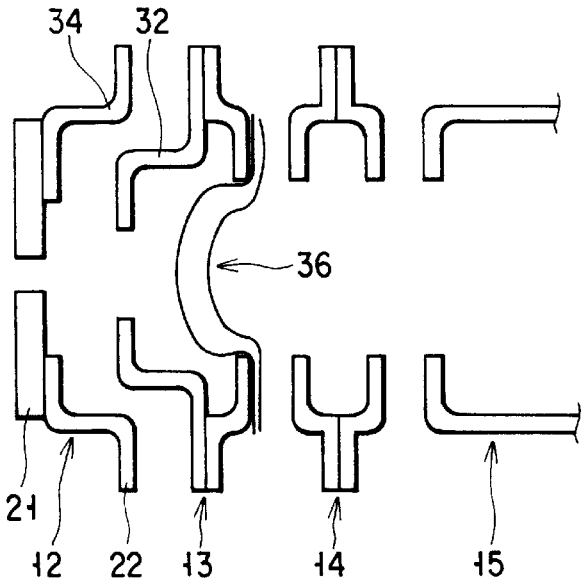
FIG. 5 (PRIOR ART)
FIG. 5 is a diagram showing the state of the electric field distribution of the auxiliary lens obtained when the electrode shown in FIGS. 3A through 3C is used.
Figure 6A:
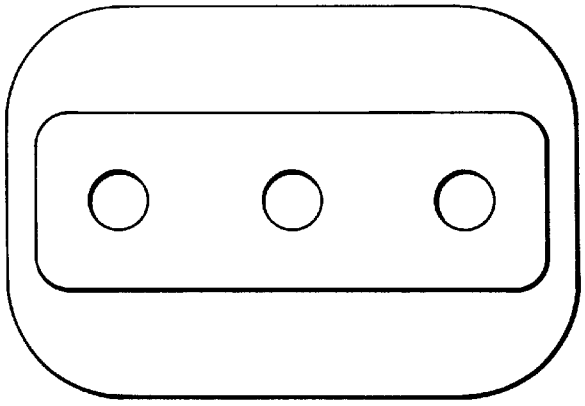
FIG. 6A (PRIOR ART)
FIG. 6A is a top view of a cup-shaped electrode applied to a third grid of the conventional electron gun assembly seen from a second grid side.
Figure 6B:
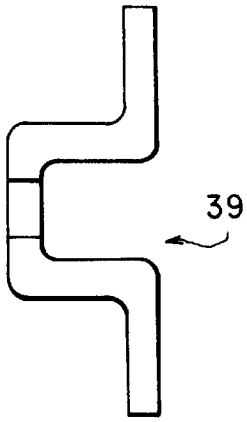
FIG. 6B (PRIOR ART)
FIG. 6B is a sectional view of a cup-shaped electrode applied to a third grid of the conventional electron gun assembly seen from an in-line direction.
Figure 6C:
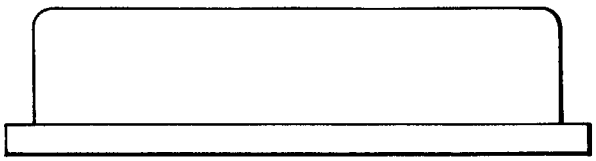
FIG. 6C (PRIOR ART)
FIG. 6C is a sectional view of a cup-shaped electrode applied to a third grid of the conventional electron gun assembly seen from a vertical direction.
Figure 7:
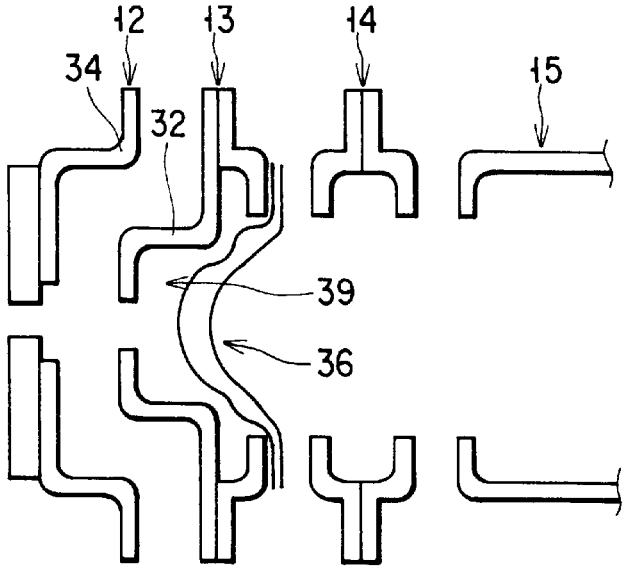
FIG. 7 (PRIOR ART)
FIG. 7 is a diagram showing the state of the electric field distribution of an auxiliary lens obtained when the electrode shown in FIGS. 6A through 6C is used.

Hereafter, embodiments of an electron gun assembly according to the present invention will be described in detail by referring to the drawing.

Figure 8:
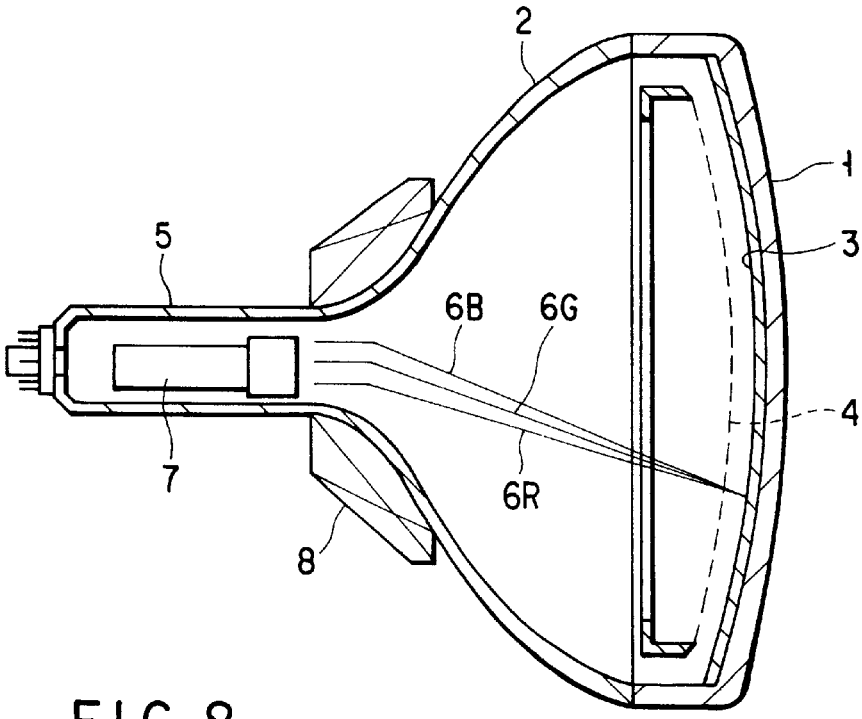
FIG. 8 is a sectional view obtained by cutting, along an in-line direction, a color picture tube to which an electron gun assembly of the present invention is applied.

FIG. 8 schematically shows an example of the structure of a color picture tube to which an electron gun assembly according to the present invention is applied. As shown in FIG. 8, the color picture tube has an envelope formed by a panel 1 and a funnel 2 integrally joined to the panel 1. A phosphor screen 3 (target) having stripe-shaped or dot-shaped three-color phosphor layer emitting blue, green and red light is formed on the inside of the panel 1. A shadow mask 4 having a large number of apertures inside is mounted so as to be opposed to the phosphor screen 3.

An electron gun assembly 7 emitting three electron beams 6B, 6G and 6R is disposed in a neck 5 of the funnel 2. A deflection yoke 8 for generating a horizontal deflection magnetic field and a vertical deflection magnetic field is mounted outside the funnel 2.

In the color picture tube having such a structure, three electron beams 6B, 6G and 6R emitted from the electron gun assembly 7 are deflected by the horizontal deflection magnetic field and the vertical deflection magnetic field generated by the deflection yoke 8. The phosphor screen 3 is scanned horizontally and vertically via the shadow mask 4 by three electron beams 6B, 6G and 6R. As a result, a color picture is displayed.

An electron gun assembly 7 used in this embodiment is an in-line electron gun assembly of QPF type (hereafter abbreviated to electron gun assembly) which emits three electron beams 6B, 6G and 6R passing on the same horizontal plane. The center beam 6G and one pair of side beams 6B and 6R located on both sides thereof are disposed in line.

Figure 9:
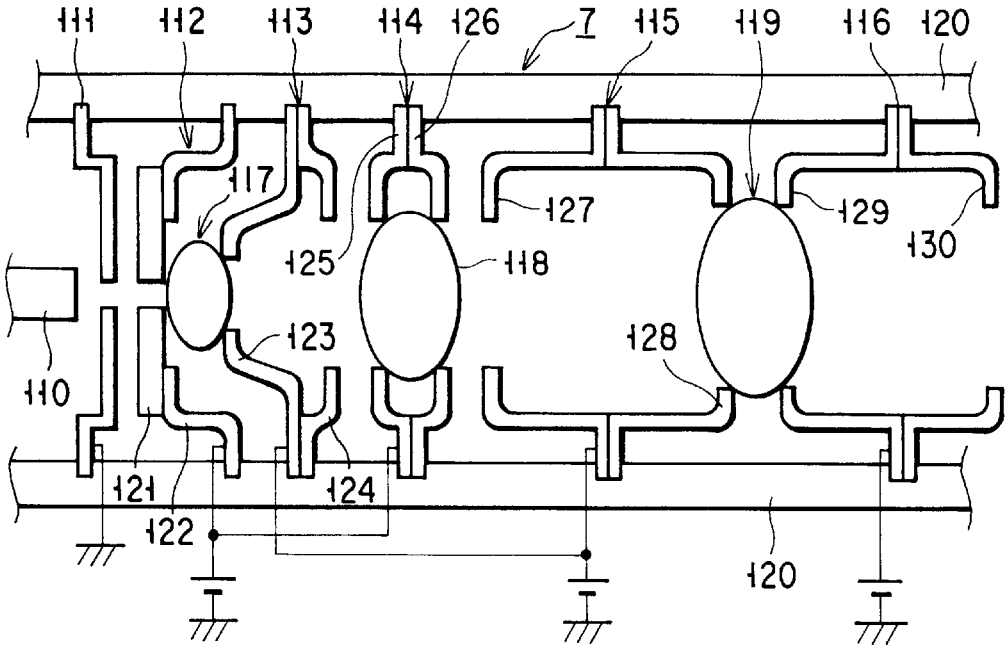
FIG. 9 is a sectional view schematically showing an electron gun assembly of the present invention.

FIG. 9 schematically shows the sectional view of an electron gun assembly seen from the in-line direction, i.e., the horizontal direction.

As shown in FIG. 9, the electron gun assembly 7 includes a cathode 110, a first grid 111, a second grid 112, a third grid 113, a fourth grid 114, a fifth grid 115, and a sixth grid 116 disposed in order along the tube axis direction. The cathode and grids are sandwiched between bead glass pairs 120 serving as insulation supports in the vertical direction and fixed. In the first through sixth grids 111 through 116, three electron beam passing holes respectively passing three electron beams are formed along the in-line direction.

The first grid 111 is a thin laminar electrode which has three electron beam passing holes each having a small diameter.

The second grid 112 includes a thick flat plate 121 with three electron beam passing holes each having a small diameter formed therethrough, and a support 122 which supports the thick flat plate 121 on the third grid side and which is open on the third grid side. The support 122 is planted in bead glass in a position located nearer the third grid than the thick flat plate 121.

The third grid 113 is formed by confronting opening ends of two cup-shaped electrodes 123 and 124 with each other. The cup-shaped electrode 123 disposed on the second grid side has three electron beam passing holes formed therethrough. Each of the three electron beam passing holes is slightly larger in diameter than each of the electron beam passing holes of the second grid 112. The cup-shaped electrode 124 disposed on the fourth grid side has three electron beam passing holes formed therethrough. Each of the three electron beam passing holes is larger in diameter than each of the electron beam passing holes of the cup-shaped electrode 123.

The fourth grid 114 is formed by confronting opening ends of two cup-shaped electrodes 125 and 126 with each other. Each of the two cup-shaped electrodes 125 and 126 has three electron beam passing holes formed therethrough. The three electron beam passing holes are substantially equal in diameter to the electron beam passing holes formed through the cup-shaped electrode 124 of the third grid 113.

The fifth grid 115 is formed by confronting opening ends of two cup-shaped electrodes 127 and 128 with each other. The cup-shaped electrode 127 disposed on the fourth grid side has three electron beam passing holes formed therethrough. Each of the three electron beam passing holes is substantially equal in diameter to each of the electron beam passing holes of the fourth grid 114. The cup-shaped electrode 128 disposed on the sixth grid side has three electron beam passing holes formed therethrough. Each of the three electron beam passing holes is larger in diameter than each of the electron beam passing holes of the cup-shaped electrode 127.

The sixth grid 116 is formed by confronting opening ends of two cup-shaped electrodes 129 and 130 with each other. Each of the cup-shaped electrode 129 disposed on the fifth grid side and the cup-shaped electrode 130 disposed on the phosphor screen side has three electron beam passing holes formed therethrough. The three electron beam passing holes are substantially equal in diameter to the electron beam passing holes formed through the fifth grid 115.

In order to be planted in the bead glass 120, each of the first through sixth grids 111 through 116 has planting portions formed by extending parts of the electrode in the vertical direction.

The cathode 110 is supplied with, for example, a direct current voltage of approximately 150V and a modulation signal corresponding to the picture signal. Furthermore, the first grid 111 is grounded. The second grid 112 and the fourth grid 114 are connected together within the tube. To these grids, a direct current voltage in the range of approximately 600 to 1000V is applied. The cathode 110, the first grid 111, and the second grid 112 form a triode. The triode emits three electron beams in parallel in the in-line direction, and forms a crossover of the electron beams.

The third grid 113 and the fifth grid 115 are connected together within the tube. To these grids, a focus voltage in the range of approximately 6 to 10 kV is applied. To the sixth grid 116, an anode voltage in the range of approximately 25 to 35 kV is applied.

The second grid 112 and the third grid 113 form a pre-focus lens 117 and focus three electron beams emitted from the triode preliminarily. The third grid 113, the fourth grid 114, and the fifth grid 115 form an auxiliary lens 118 and further focus the three electron beams preliminarily. The fifth grid 115 and the sixth grid 116 form a main lens 119 and finally focus the three electron beams onto the screen. The auxiliary lens 118 and the main lens 119 are generically called main lens system.

The structure of the second grid 112 and the third grid 113 applied to the above described electron gun assembly will now be described by referring to drawing.

Figure 11A:
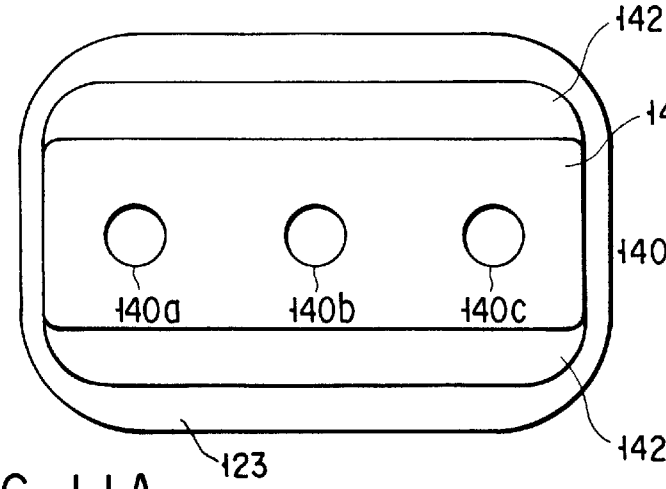
FIG. 11A is a top view of a cup-shaped electrode applied to a second grid side of a third grid in an electron gun assembly according to the present invention seen from a second grid side.
Figure 11B:
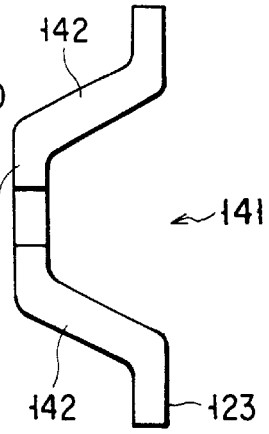
FIG. 11B is a sectional view of a cup-shaped electrode applied to a second grid side of a third grid in an electron gun assembly according to the present invention seen from an in-line direction.
Figure 11C:
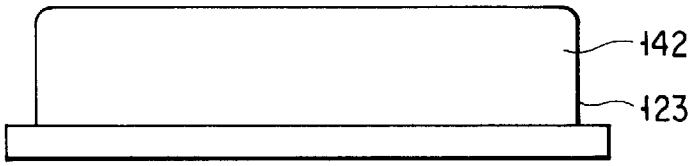
FIG. 11C is a side view of a cup-shaped electrode applied to a second grid side of a third grid in an electron gun assembly according to the present invention seen from a vertical direction.

FIGS. 11A through 11C schematically show the cup-shaped electrode 123 of the third grid 113 disposed on the second grid side. FIG. 11A is a top view of the electrode seen from the second grid side. FIG. 11B is a sectional view of the electrode seen from the in-line direction, i.e., from the horizontal direction. FIG. 11C is a side view of the electrode seen from a direction perpendicular to the in-line direction, i.e., from the vertical direction.

As shown in FIGS. 11A to 11C, three electron beam passing holes 140*a*, 140*b*, and 140*c* arranged in line along the horizontal direction are formed through a plane portion of the electrode 123, i.e., through a bottom face 140 so as to correspond to three electron beams, respectively. The bottom face 140 is formed so as to take the shape of substantially a rectangle having a longer side in the horizontal direction and a shorter side in the vertical direction. The shorter side of the bottom face 140 is formed so as to be shorter than the width of the opening portion 141 in the vertical direction. Side walls 142 are formed so as to be inclined with respect to the tube axis over a range from the opening portion 141 facing the side of the fourth grid 114 to the bottom face 140 facing the side of the second grid 112. Longer sides of the bottom face 140 and longer sides of the opening portion 141 are joined together by the side walls 142.

Figure 12A:
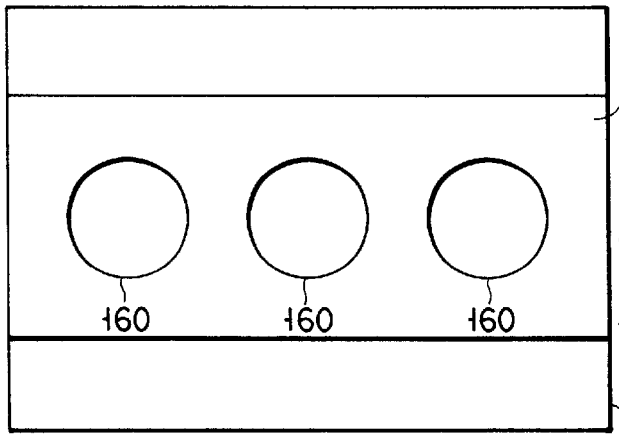
FIG. 12A is a top view of a support applied to a third grid side of a second grid in an electron gun assembly according to the present invention seen from a first grid side.
Figure 12B:
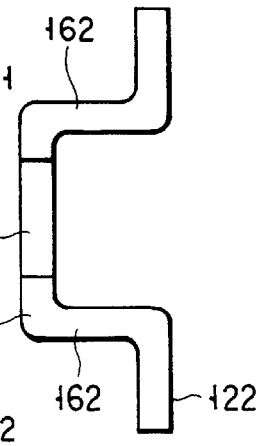
FIG. 12B is a sectional view of a support applied to a third grid side of a second grid in an electron gun assembly according to the present invention seen from an in-line direction.

FIG. 12A is a top view of the support 122 of the second grid 112 seen from the side of the first grid 111. FIG. 12B is a sectional view of the support 122 seen from the in-line direction.

As shown in FIGS. 12A and 12B, the support 122 has holes 160 formed through a plane portion 161 contacting the thick flat plate 121. The holes are larger than the electron beam passing holes of the thick flat plate 121. Side walls 162 substantially parallel to the tube axis direction are joined to the top and bottom of the plane portion 161. An end of each of the side walls 162 is folded into the vertical direction to form a planting portion. The planting portion is planted in the bead glass serving as the insulation support.

Figure 10:
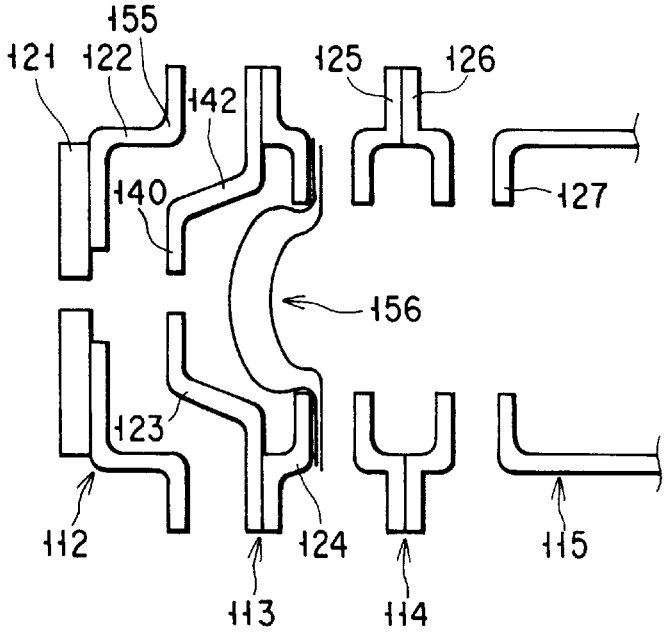
FIG. 10 is a sectional view showing the structure of the electron gun assembly shown in FIG. 9 ranging from a second grid to a fifth grid.

FIG. 10 is a sectional view of the second grid 112 to the fifth grid 115 included in the electron gun assembly seen from the in-line direction.

The cup-shaped electrode 123 of the third grid 113 disposed on the second grid side is disposed in such a position that its bottom face 140 is surrounded by the support 122 of the second grid 112. As already described with reference to FIG. 11, side walls 142 joined to longer sides of the bottom face 140 are formed so as to be inclined from the side of the fourth grid 114 to the bottom face 140 of the side of the second grid 112. Therefore, the space between the folded portion 155 in the support 122 of the second grid 112 and the side wall 142 of the cup-shaped electrode 123 can be made wide. As a result, a leak between the second grid 112 and the third grid 113 can be prevented, and the withstand voltage characteristics can be improved.

Furthermore, the width of the opening portion 141 of the cup-shaped electrode 123 in the vertical direction is formed so as to be wider than the shorter side of the bottom face 140. Therefore, the opening portion 141 and the side walls 142 can be disposed in positions apart from an electric field 156 of the auxiliary lens 118 penetrating from the side of the fourth grid 114 to the side of the third grid 113. As a result, asymmetry of the auxiliary lens 118 in the horizontal direction and vertical direction can be suppressed. Therefore, it becomes possible to suppress the distortion of the shape of the beam spot formed on the screen.

In addition, since the cup-shaped electrode 123 does not take a shape which causes difficulty in manufacturing, there is not a fear of an increase in cost, either.

Another structure of the cup-shaped electrode of the third grid disposed on the second grid side will now be described.

Figure 13A:
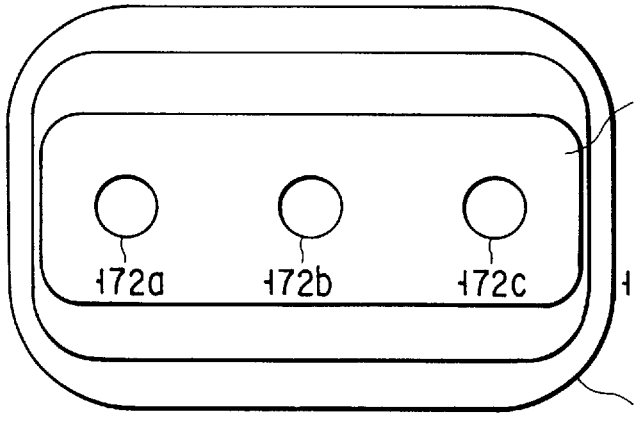
FIG. 13A is a top view of another cup-shaped electrode applied to a second grid side of a third grid in an electron gun assembly according to the present invention seen from the second grid side.
Figure 13B:
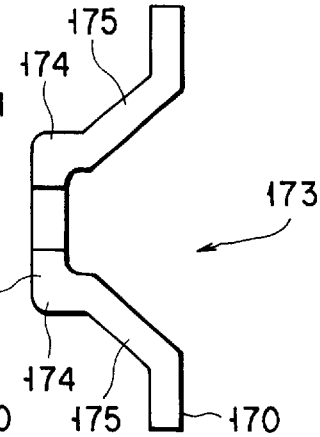
FIG. 13B is a sectional view of another cup-shaped electrode applied to a second grid side of a third grid in an electron gun assembly according to the present invention seen from an in-line direction.
Figure 13C:
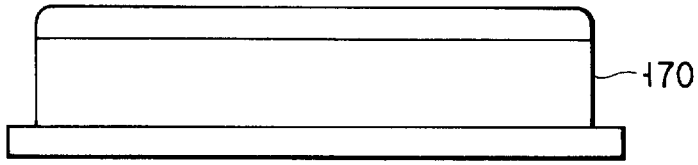
FIG. 13C is a side view of another cup-shaped electrode applied to a second grid side of a third grid in an electron gun assembly according to the present invention seen from a vertical direction.

FIGS. 13A through 13C schematically show a cupshaped shaped electrode 170 of the third grid 113 disposed. on the second grid side. The cup-shaped electrode 170 has another structure. FIG. 13A is a top view of the electrode seen from the second grid side. FIG. 13B is a sectional view of the electrode seen from the in-line direction. FIG. 13C is a side view of the electrode seen from the vertical direction.

As shown in FIGS. 13A to 13C, three electron beam passing holes 172*a*, 172*b*, and 172*c* arranged in line along the horizontal direction are formed through a plane portion of the electrode 170, i.e., through a bottom face 171 so as to correspond to three electron beams, respectively. The bottom face 171 is formed so as to take the shape of substantially a rectangle having a longer side in the horizontal direction and a shorter side in the vertical direction. The shorter side of the bottom face 171 is formed so as to be shorter than the width of the opening portion 173 in the vertical direction.

In the example shown in FIGS. 11A through 11C, each of the side walls 142 joined to the longer sides of the bottom face 140 is formed by one plane. In the example shown in FIGS. 13A through 13C, however, each side wall is formed two planes, i.e., a first plane 174 joined vertically to the longer side of the bottom face 171, and a second plane 175 coupling the first plane 174 to the opening portion 173. In other words, the first planes 174 are extended substantially in parallel to the tube axis, and the second planes 175 are extended obliquely to the tube axis.

Figure 14:
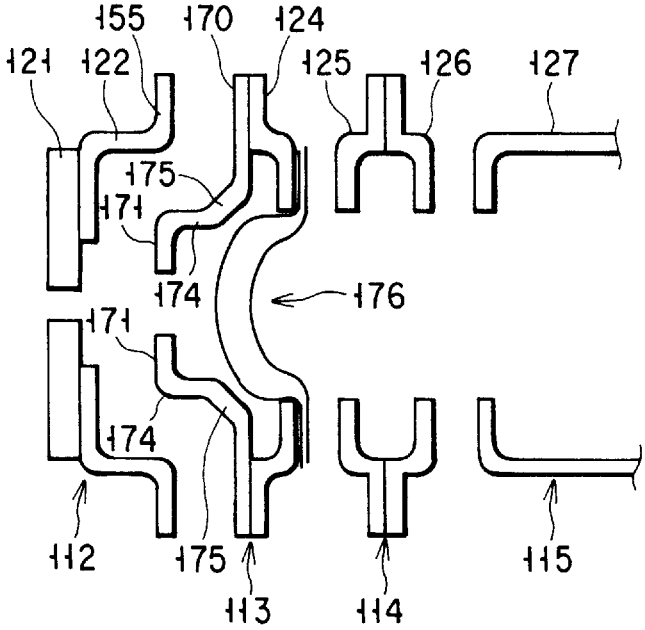
FIG. 14 is a diagram showing an electrode arrangement of a second grid to a fifth grid in the case where the cup-shaped electrode shown in FIGS. 13A through 13C is applied.

Also if the cup-shaped electrode 170 of the third grid 113 is formed so as to take the shape shown in FIGS. 13A through 13C as described above, it becomes possible as shown in FIG. 14 to widen the distance between the folded portion 155 of the support 122 of the second grid 112 and the side walls 174 and 175 formed by two planes joining the longer side of the bottom face 171 of the cup-shaped electrode 170 to the opening portion 173. Thus a leak can be prevented. Therefore, it becomes possible to improve the withstand voltage characteristics of the second grid 112 and the third grid 113. Furthermore, the influence of the side walls 174 and 175 exerted upon the electric field 176 of the auxiliary lens can be suppressed. It is possible to suppress the asymmetry of the auxiliary lens 118 in the horizontal direction and the vertical direction. In addition, it becomes possible to prevent the manufacturing cost of the cup-shaped electrode 170 from largely increasing.

Figure 15:
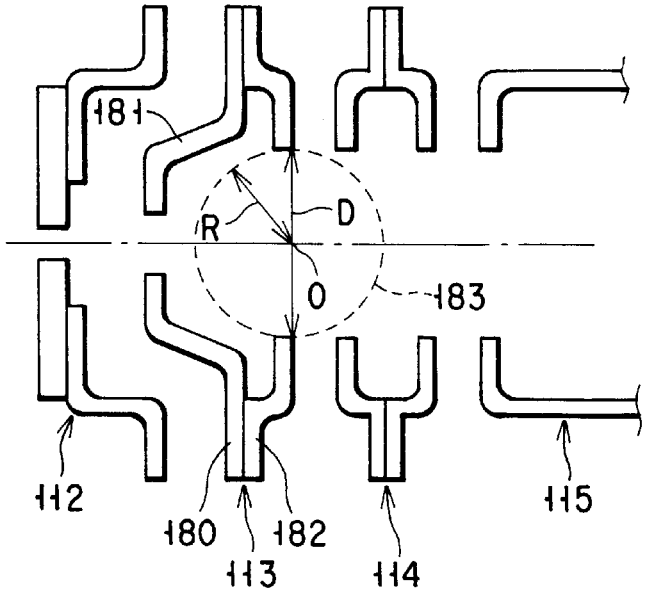
FIG. 15 is a diagram showing the relation of a distance between side walls of a cup-shaped electrode of a third grid disposed on the second grid side in an electron gun assembly and an opening center of a cup-shaped electrode disposed on the fourth grid side, and showing the case where the side wall is at a distance of at least the radius of the opening from the opening center.

In the cup-shaped electrode 123 shown in FIGS. 11A through 11C and the cup-shaped electrode 170 shown in FIGS. 13A through 13C, it is not sufficient that the walls joined to the longer sides of the bottom face are simply inclined toward the opening portion. In other words, for preventing the symmetry of the auxiliary lens 118 being affected, it is necessary as shown in FIG. 15 for the space between a side wall 181 of a cup-shaped electrode 180 located on the second grid side of the third grid 113 and a hole center O of an electron beam passing hole of a cup-shaped electrode 182 located on the fourth grid side of the third grid 113 to be at least a radius R of a circle 183 having the width of an electron beam passing hole of the cup-shaped electrode 182 as its diameter.

Figure 16:
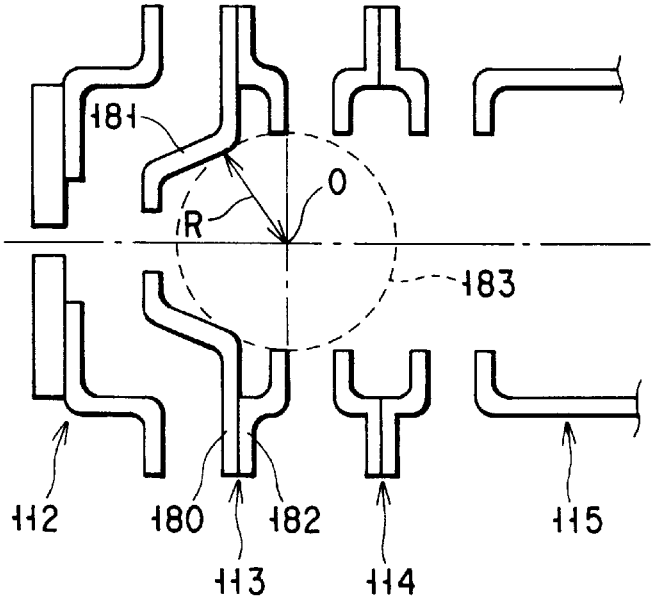
FIG. 16 is a diagram showing the relation between a side wall of a cup-shaped electrode disposed on the second grid side of a third grid in an electron gun assembly and a distance as far as an opening center of a cup-shaped electrode disposed on the fourth grid side, and showing the case where the side wall is at a distance of the radius of the opening or less from the opening center.

If the side walls 181 of the cup-shaped electrode 180 are disposed at a distance smaller than the radius R of the circle 183 from the hole center O of the cup-shaped electrode 182 as shown in FIG. 16, the electric field of the auxiliary lens is affected and asymmetry occurs in the horizontal direction and the vertical direction of the auxiliary lens. Therefore, it is necessary to dispose the side walls 181 of the cup-shaped electrode 180 of the third grid 113 at a distance equal to at least the radius R of the hole from the hole center of the cup-shaped electrode 182 located on the fourth grid side.

Heretofore, the electron gun assembly of the present invention has been described. The second grid is not limited to the two-part configuration including a thick flat plate and a support. Regardless of the number of parts, the second part having a similar shape is also included in the scope of the present invention.

In the electron gun assembly of the present invention as described above, the second grid side of the third grid is formed by a cup-shaped electrode, each of the plane portion and the opening portion of the cup-shaped electrode is formed so as to take the shape of substantially a rectangle having longer sides in the in-line direction, and the width of the shorter sides of the plane portion is formed so as to be shorter than that of the shorter sides of the opening portion. Therefore, it becomes possible to make the distance between the second grid and the third grid large enough to prevent occurrence of electric discharge while disposing the third grid near the second grid. It thus becomes possible to improve the withstand voltage characteristics.

It becomes possible to suppress a bad influence exerted upon the electric field of the auxiliary lens penetrating from the fourth grid to the third grid. It becomes possible to suppress the asymmetry of the auxiliary lens in the horizontal direction and the vertical direction, and suppress the distortion of the beam spot on the screen.

Further, since the structure of the electrode has a simple shape, it can be fabricated simply and a significant increase of the manufacturing cost can be prevented.

INDUSTRIAL APPLICABILITY

As heretofore described, the present invention can provide an electron gun assembly including an electrode having a simple structure capable of improving the withstand voltage characteristics without affecting the auxiliary lens.

What is claimed is:

1. An electron gun assembly including a plurality of cathodes arranged in an in-line direction, a plurality of grids containing at least first through fourth grids having electron beam passing holes arranged in an in-line direction, and an insulation support for sandwiching said cathodes and said grids between and fixing said cathodes and said grids from a direction perpendicular to the in-line direction, said second grid and said fourth grid being supplied with a substantially same low potential, said third grid being supplied with a potential higher than the potential of said fourth grid, and said second grid being fixed to said insulation support on a side of said third grid with respect to a plane having said electron beam passing holes, wherein said third grid comprises a cup-shaped electrode on a side of said second grid;

said cup-shaped electrode comprises a plane portion having electron beam passing holes, an opening portion, and planting portions planted in said insulation support;

each of said plane portion and said opening portion takes a shape of substantially a rectangle having longer sides in the in-line direction, the longer sides of said plane portion are joined to the longer sides of said opening portion with side walls each substantial prescribed by one plane; and a width of said opening portion in the direction perpendicular to the in-line direction is larger than a width of said plane portion in the direction perpendicular to the in-line direction.

2. An electron gun assembly according to claim 1, wherein said third grid comprises, on a side of said fourth grid, a cup-shaped electrode having holes allowing passage of electron beams, and each of the side walls included in the cup-shaped electrode of said third grid located on said second grid side and joining the longer sides of said plane portion to the longer sides of said opening portion is disposed at a distance longer than a radius of said holes from a center of said holes.

* * * * *